United States Patent [19]

Holcomb

[11] Patent Number: 5,033,692

[45] Date of Patent: Jul. 23, 1991

[54] LEVEL WIND SPOOLING DEVICE WITH REDUCED WEAR, FRICTION AND OIL CONTAMINATION

[76] Inventor: Jimmy F. Holcomb, Rte. 1, Box 37B, Liemoris, W. Va. 25125

[21] Appl. No.: 489,067

[22] Filed: Mar. 6, 1990

[51] Int. Cl.[5] ..... B65H 54/28

[52] U.S. Cl. ..... 242/158.3; 74/57

[58] Field of Search ..... 242/158.3, 158 R, 158 B, 242/158 F, 158.1, 158.2, 158.4 R, 158.4 A, 43 R; 74/55, 56, 57, 58, 59

[56] References Cited

U.S. PATENT DOCUMENTS

| | | | |
|---|---|---|---|
| 890,213 | 6/1908 | Campbell . | |
| 1,186,909 | 6/1916 | Huttelmaier | 242/158 R |
| 1,632,875 | 6/1927 | Bouvier . | |
| 1,875,467 | 9/1932 | Knoerzer et al. . | |
| 1,935,585 | 11/1933 | Tornblom . | |
| 2,134,369 | 10/1938 | Merwin . | |
| 2,660,382 | 11/1953 | Wilson | 242/158 R |
| 2,801,534 | 8/1957 | Astley . | |
| 2,962,906 | 12/1960 | Cornish . | |
| 3,353,760 | 11/1967 | Brehm . | |
| 3,401,894 | 9/1968 | Campbell . | |
| 3,587,994 | 6/1971 | Freed . | |
| 3,784,126 | 1/1974 | Petry | 242/158.3 |
| 3,836,087 | 9/1974 | Tschentscher . | |
| 3,968,939 | 7/1976 | Bense . | |

*Primary Examiner*—Stanley N. Gilreath
*Attorney, Agent, or Firm*—Jim Zegeer

[57] ABSTRACT

A level wind spooling device has a housing with lateral end walls, top, bottom, front and back walls forming a lubrication chamber. A spooling shaft journaled in the end walls is adapted to be connected to a rotary drive and has a cam track formed on the surface thereof and a cam track follower is engageable with the cam track and operatively moves the cam track follower back and forth along a linear path. An arm secured to the follower and passing through a slot in the housing and a flexible strand guide is secured to the arm means. Metal-to-metal sliding action is eliminated and thus reducing wear, oil contamination from metal particles and heat generation and is more efficient. The spooling shaft is lower in the oil housing to allow the spooling shaft to be more completely immersed in oil for better lubrication of all internal components. The carriage follower assembly utilizes four roller bearings, two on each side, and four steel guide bars, two on each side so that all internal and external forces which tend to distort or damage the spooling shaft are eliminated. This arrangement results in a level winding device having greater life and a higher efficiency.

8 Claims, 2 Drawing Sheets

LEVEL WIND SPOOLING DEVICE WITH REDUCED WEAR, FRICTION AND OIL CONTAMINATION

FIELD OF THE INVENTION

This invention relates to a more efficient level wind spooling device with reduced wear, friction and oil contamination and better lubrication of the spooling shaft and carriage follower.

THE PRIOR ART

Level wind spooling devices are well known in the art, reference being made particular to Petry U.S. Pat. No. 3,784,126 and the description of prior art in said Petry patent which is incorporated herein by reference.

The Petry device utilizes stabilizing bars in all four walls of the oil pan housing assembly to stabilize the carriage follower assembly. This involves metal-to-metal sliding action and thus produces heavy wear on the sliding metal parts, oil contamination and friction and heat and places more loading on the device. Elimination of any of the plurality of stabilizing guide bars reduces the stability of the unit.

THE PRESENT INVENTION

According to the present invention, the spooling shaft is located close to the bottom of the oil pan housing and the carriage follower is guided by front and rear pairs of guide bars which are spaced to receive caged roller bearings mounted on the front and rear of the carriage follower. The bearing rollers eliminate sliding metal to metal contact. This arrangement reduces the wear, friction and oil contamination present in devices such as disclosed in the Petry patent, permits the spooling shaft to be lowered to allow it to be better immersed in oil for better lubrication. Moreover, the carriage follower assembly, which in the preferred embodiment utilizes four roller bearings, two on each side and the four steel guide bars, two on each side, so that all internal and external forces tending to distort or damage the spooling shaft are reduced or eliminated. The invention features an oil pan housing utilizing two guide bars on each side, and a cam follower assembly utilizing two caged roller bearings, each caged roller bearing assembly having two spaced apart caged roller bearings bolted to each side to let the cam follower assembly move freely without friction and without excess wear. Each of the bearings roll between the upper and lower guide bars which are made of hardened steel. The two top guide bars are bolted in place to allow for easy assembly and disassembly and the two bottom bars are permanently affixed in place as by welding. By this means, the carriage follower assembly is completely stabilized and, as noted above, virtually all outside and inside forces which could be applied to the spooling shaft are minimized or eliminated.

Thus, the basic object of the invention is to provide an improved level wind spooling device which has reduced friction, wear and tear, and oil contamination and is easily disassembled for cleaning and/or repair, is more efficient and has a much longer life than prior art level wind spooling assemblies.

BRIEF DESRIPTION OF THE DRAWINGS

The above and other objects, advantages and features of the invention will become more apparent when considered with the following specification and accompanying drawings wherein:

FIG. 1 is a top plan view of the level wind spooling device disclosed in the prior art Petry patent, FIG. 2 is an end view of the level wind spooling device disclosed in the prior art Petry patent, FIG. 3 is an end view in elevation and in section, illustrating in detail the features of the present invention, and FIG. 4 is a top plan view of a level wind spooling device incorporating the present invention.

DETAILED DESCRIPTION OF THE PREFERRED EMBODIMENT

Figure 1:
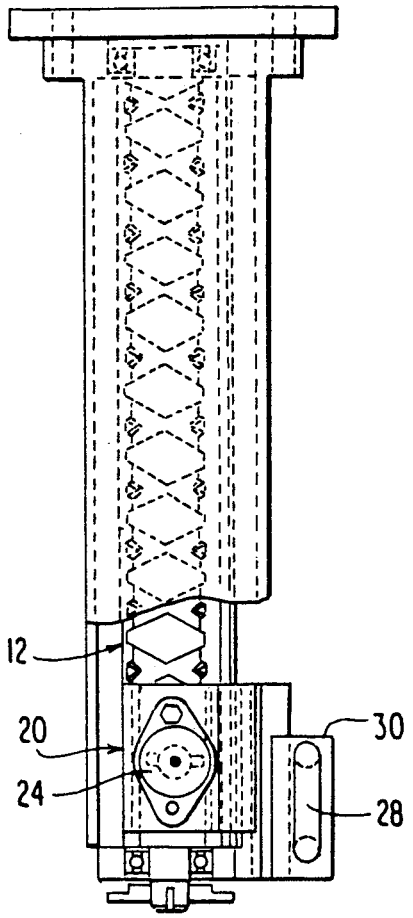
FIG. 1 PRIOR ART
Figure 2:
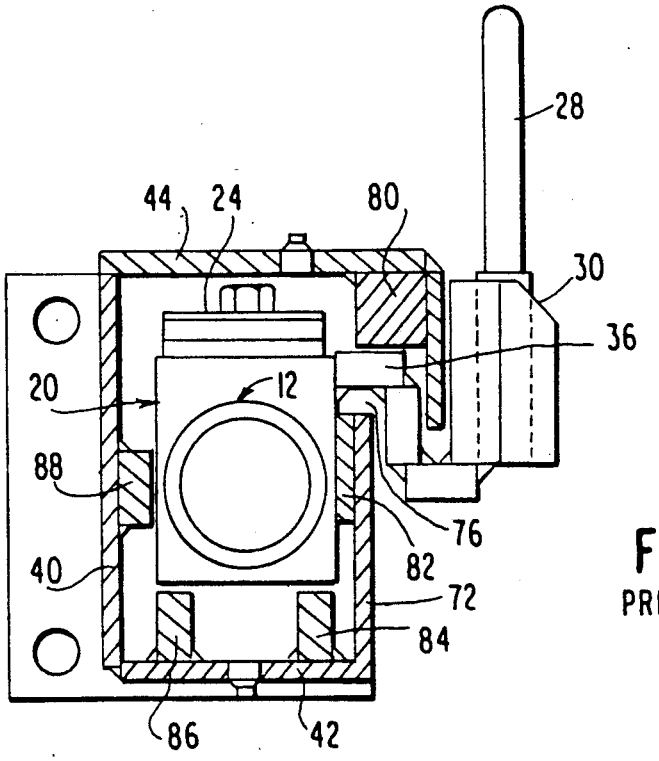
FIG. 2 PRIOR ART

Referring to FIGS. 1 and 2, the device of the Petry patent utilizes stabilizing bars 80, 82, 84, 86 and 88 on the top wall 44, front wall 72, bottom wall 42, and back wall 40, respectively. Cam track follower 20 has front, bottom and side surfaces which slide on front stabilizing bar 82, bottom stabilizing bars 84, 86, and rear stabilizing bar 88. Follower 20 is engageable with spooling shaft 12 via actuator 24. Connecting member 36 has an upper surface which bears on the bottom surface of guide bar 80 and projects through a slot 76 to connect the follower assembly 20 to guide member 30 which has a U-shaped guide 28 mounted thereon. In heavy use and load conditions, the metal-to-metal sliding action between cam follower 20 and guides 82, 84, 86 and 88 and connecting arm 36 and guide 80 can result in a relatively short life for the unit and the oil is contaminated and there is excessive heat build-up.

According to the present invention, the metal-to-metal sliding action is eliminated thus reducing wear, oil contamination and heat and improving the efficiency. Moreover, the spooling shaft is lowered for better lubrication. Finally, by design of the carriage follower assembly utilizing four roller bearings, two on each side and the four steel guide bars, two on each side, all internal and external forces tending to distort spooling shaft are eliminated.

Figure 3:
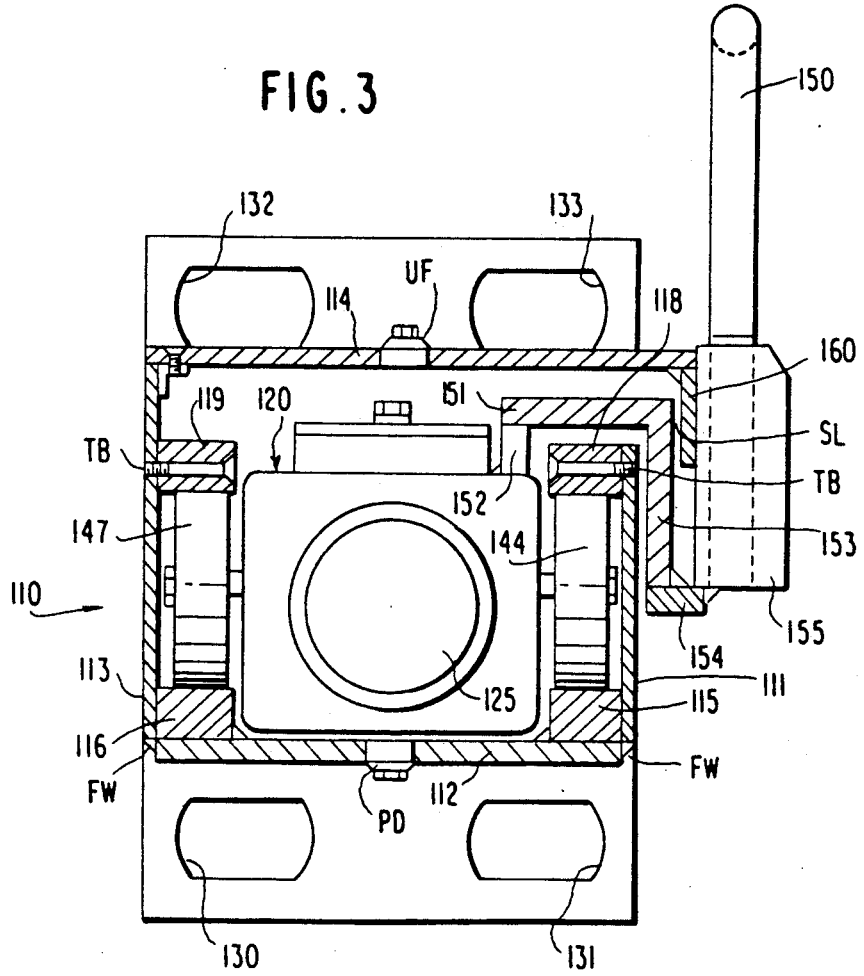
Figure 4:
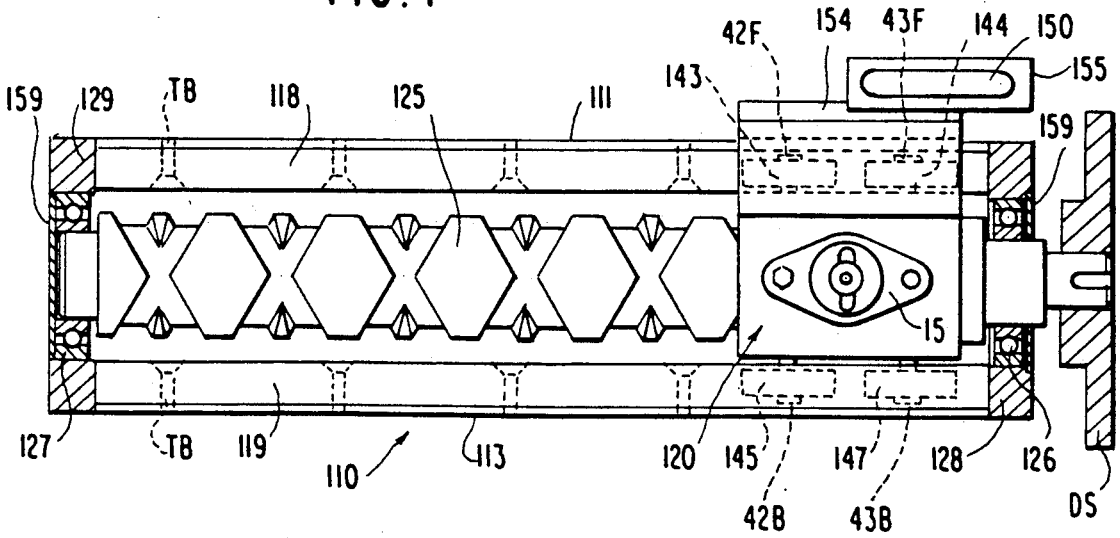

Referring now to FIGS. 3 and 4, oil pan housing 110 is provided with front wall 111, bottom wall 112, back wall 113 welded by filet welds FW. Rectangular, hardened key steel guides or rails 115, 116 are welded in the inside lower corners to provide bracing for the sidewalls and bottom and, at the same time, provide a guide for caged roller bearings to be described more fully hereafter. Near the top inside of front wall 111 and back wall 113 are bolted two additional hardened steel guides or rails 118 and 119, respectively, which are bolted in place after installation of the carriage follower assembly 120. This arrangement thus permits the cam follower assembly and the spooling shaft 125 to be positioned so as to be better immersed in the oil pool maintained in the housing 110 for better lubrication of the spooling shaft 125, follower 120 and roller bearings and guide rails. The oil can be added through an upper fill UF and drained through plugged drain PD in bottom wall 112. Spooling shaft 125 is journaled by bearings 126, 127 in end plates or walls 128, 129 which are welded to the lateral ends of front wall 111, bottom wall 112 and back wall 113. Top wall 114 is secured by brackets and bolts to the tops of back wall 113. The end plate or wall 129 has elongated mounting bolt holes 130, 131, 132, 133, there being four such bolt holes in each end plate to allow for adjustment. Carriage follower assembly 120 has a pair of laterally projecting stub axles 42F, 43F on the front side and two 42B, 43B on the back side upon which are mounted caged roller bearings 143, 144, 145, and 146, respectively. The top bars 118 and 119 are bolted in place by bolts TB. A very small clearance of 1/16" to 1/32" provided at the top of the rollers is adequate. Depending on the direction of rotation of the spooling shaft 125, the carriage follower assembly and its laterally extending caged roller bearings 143, 144, 145 and 146 will bear either on the lower right guide bar 115 and upper left guide bar 119, or lower left guide bar 116 and upper right guide bar 118 and roll freely as the carriage follower assembly is moved by the right and left-handed threads on the spooling cam shaft (see FIG. 4).

An actuator 15 can be engaged or disengaged to engage the cam follower carriage with the right-left-handed threaded shaft. The vertical strand guide assembly 150 is secured by arms 151, 152, 153, 154 and 155 to carriage follower assembly 120 and extend through the slot SL formed between the depending short wall 160. The spooling shaft itself is coupled to a drive sprocket DS shown on the right end of the shaft in FIG. 4. Snap rings 159 are utilized to seal the bearing journals for the cam shaft in the end plates or walls 128, 129.

Thus, this invention eliminates the metal-to-metal sliding action and thus reduces wear, oil contamination and heat generation and is more efficient. Moreover, in the preferred embodiment, the spooling shaft is lowered in the oil housing to allow the spooling shaft to be more completely immersed in oil for better lubrication of all internal components. The carriage follower assembly utilizes four roller bearings, two on each side, and four steel guide bars, two on each side so that all internal and external forces which tend to distort or damage the spooling shaft are eliminated. Metal particles from the sliding of metal-on-metal are eliminated thus avoiding lubricant contamination and possible damage to the spooling shaft and carriage follower by loose metal particles. This arrangement results in a level winding device having greater life and a higher efficiency in that it reduces the loading on the drive device.

While I have disclosed a preferred embodiment of my invention, it will be clear that variations of details of construction which are specifically illustrated and described may be resorted to without departing from the true spirit and scope of the invention as defined in the appended claims.

What is claimed is:

1. In a level wind spooling device having a housing with lateral end walls, elongated top, bottom, front and back walls forming a lubrication chamber, bearing means in said lateral end walls, a spooling shaft journaled in said bearing means and having a drive end projecting through one of said end walls and adapted to be connected to a rotary drive, cam track means formed on the surface of said spooling shaft and a cam track follower on said spooling shaft and engageable with said cam track means for operatively moving the cam track follower back and forth along a linear path, said cam track follower having front and back surfaces and means forming an elongated slot in one of said elongated walls and arm means secured to the follower and passing through said slot and a flexible strand guide secured to said arm means, the improvement comprising a pair of guide bar means spacedly secured, one above the other, to said front wall, a further pair of guide bar means spacedly secured, one above the other, to said back wall, and roller bearing means secured to said front and back surfaces, respectively, of said cam shaft follower, said roller bearing means being positioned between and guided by said pairs of guide bars on said front and back walls, respectively.

2. The level spooling device defined in claim 1 wherein the upper ones of said guide bar means is secured above said roller bearing means by bolts for removable securement to said front and back walls, respectively.

3. The level wind spooling device defined in claim 1 wherein each said roller bearing means is constituted by a pair of spaced roller bearing means on said front and back surfaces of said cam track follower, respectively.

4. In a level wind spooling device, a housing having lateral end walls, elongated top, bottom, front and back walls forming a lubricant chamber, bearing means in said lateral end walls and a spooling shaft journaled in said bearing means and having a drive end projecting through one of said end walls and adapted to be connected to a rotary drive, cam track means formed on the surface of said spooling shaft, a cam track follower on said spooling shaft and in engagement with said cam track means for operatively moving said follower back and forth along a linear path, means forming an elongated slot in one of said elongated walls, arm means secured to said follower and passing through said slot and a flexible strand guide secured to said arm means, the improvement comprising pairs of spaced roller bearing means secured on opposites sides of said cam track follower, respectively, and upper and lower linear rail means secured to said front and rear walls, respectively, and above and below said respective roller bearing means for constraining said roller bearing means and said cam track follower to move along said linear path and preclude any sliding and rubbing contact between said follower and any portion of said housing.

5. The level wind spooling device defined in claim 4 wherein said bearing means and said spooling shaft and the axis of said spooling shaft are located close to said bottom wall so that said roller bearing means, cam track follower and said spooling shaft are better lubricated by lubricant.

6. In a level wind spooling device, a housing having lateral end walls, elongated top, bottom, front and back walls forming a lubricant chamber, bearing means in said lateral end walls and a spooling shaft journaled in said bearing means and having a drive end projecting through one of said end walls and adapted to be connected to a rotary drive, cam track means formed on the surface of said spooling shaft, a cam track follower on said spooling shaft and engageable with said cam track means for operatively moving said cam track follower back and forth along a linear path, means forming an elongated slot in one of said elongated walls, arm means secured to said cam track, follower and passing through said slot and a flexible strand guide secured to said arm means, the improvement comprising spaced pairs of caged roller bearing means with roller bearings secured at spaced points on opposite sides, respectively, of said cam track follower, and a pair of linear rail means secured to said front and rear walls, respectively, above and below said roller means for constraining said roller means and said cam track follower to move along said linear path and preclude any sliding and rubbing contact between said cam track follower and any portion of said housing, said roller means and said spooling shaft and the axis of said spooling shaft being located close to said bottom wall of said housing so that said caged roller bearing means, cam track follower and said spooling shaft are better lubricated by lubricant in the lower half of said housing.

7. The level spooling device defined in claim 1 wherein said rail means secured above said roller bearing means are removably secured to said front and back walls by threaded bolt means passing through each said rail means, respectively, and said front and back walls, respectively.

8. In a level wind spooling device having a housing with lateral end walls, top elongated, bottom, front and back walls forming a lubrication chamber, spooling shaft bearing means in said lateral end walls, respectively, a spooling shaft journaled in said spooling shaft bearing means and having a drive end projecting through one of said lateral end walls and adapted to be connected to a rotary drive, cam track means formed on the surface of said spooling shaft and a cam track follower mounted on said spooling shaft and in engagement with said cam track means for operatively moving the cam track follower back and forth along a linear path and means forming an elongated slot in one of said elongated walls and arm means secured to the follower and passing through said slot and a flexible strand guide secured to said arm means, the improvement comprising said cam track follower having a pair of oppositely facing sides, first roller bearings mounted on one of said pair of oppositely facing sides, second roller bearings mounted on the other of said pair of oppositely facing sides, linear guide rail means engaged solely by said roller bearing means secured to said front and back walls to define a straight linear path for said roller bearing means, said spooling shaft bearing means mounting said spooling shaft in the lower-most part of said housing so as to better lubricate said spooling shaft, said spooling shaft follower and said roller bearings.

* * * * *